United States Patent [19]

Kaldenberg

[11] 4,105,229

[45] Aug. 8, 1978

[54] LATCH MECHANISM FOR APPLIANCE

[75] Inventor: Henry J. Kaldenberg, Des Moines, Iowa

[73] Assignee: The Maytag Company, Newton, Iowa

[21] Appl. No.: 848,104

[22] Filed: Nov. 3, 1977

[51] Int. Cl.[2] ..... E05C 5/00

[52] U.S. Cl. ..... 292/113; 292/66; 292/DIG. 69; 126/197

[58] Field of Search ..... 292/113, 66, 114, 67, 292/223, 123, 124, 97, DIG. 69

[56] References Cited

U.S. PATENT DOCUMENTS

| | | | |
|---|---|---|---|
| 3,409,320 | 11/1968 | Eckerle | 292/113 |
| 3,476,424 | 11/1968 | Erickson | 292/66 |
| 3,642,313 | 2/1972 | Anderson | 292/66 |

*Primary Examiner*—Robert L. Wolfe
*Attorney, Agent, or Firm*—Richard L. Ward

[57] ABSTRACT

A latch mechanism for an appliance having a cabinet with an access opening and an access door for closing the access opening. The latch mechanism has a strike portion on the cabinet and a latch portion on the access door. The latch portion includes a handle rotatable in a horizontal plane and an actuating member for longitudinally shortening while transversely widening a catch member to concurrently latch and seal the access door to the cabinet.

11 Claims, 6 Drawing Figures

LATCH MECHANISM FOR APPLIANCE

BACKGROUND OF THE INVENTION

1. Field of the Invention

This invention relates generally to the field of appliance latch mechanisms and more particularly to a latch mechanism having a catch member which may be actuated between first and second longitudinal and transverse dimensions for latching and sealing an appliance door.

2. Description of the Prior Art

Prior art latch mechanisms indicate a continuing search for linkage systems which will efficiently convert rotary handle movement to linear catch movement to effectively latch and seal the door of an appliance such as a dishwasher.

Eckerle in U.S. Pat. No. 3,409,320 discloses a latch which includes a tab movable in a slot to draw the door toward the cabinet. A pin moves in a pair of arcuate slots in the frame and in the catch to convert rotary movement of the handle to linear movement of the tab and latch member in the slot as the handle is rotated.

Anderson in U.S. Pat. No. 3,642,313 utilizes a driving link pivotally connected to the latching element at one end and to the operating lever at the other end to move the bolt in response to movement of the operating lever.

Guth in U.S. Pat. No. 3,841,677 uses a slot and pin arrangement to rotate the catch behind the strike and then to pull the door closed.

All of these prior art latches disclose linkage systems having various rigid moving parts. In a preferred embodiment of the instant invention a unitary latch catch member effectively expands and contracts longitudinally and transversely in response to rotation of the handle to concurrently latch and pull the door to a sealing position.

SUMMARY OF THE INVENTION

It is therefore an object of the instant invention to provide an improved latch mechanism.

It is a further object of the instant invention to provide a latch mechanism utilizing linkage which changes in effective length and width as the latch handle is rotated.

It is a still further object in a particular embodiment of the instant invention to provide a unitary molded latch catch which is resilient and which changes its effective length and width as the latch handle is rotated to a latched position but returns to substantially its original length and width as the latch handle is returned to the unlatched position.

The instant invention achieves these objects in a latch mechanism for an appliance having a cabinet and an access door. A strike is mounted on one of the cabinet or access door and a latch mounting structure is secured to the other of the cabinet or access door. A latch assembly is supported on the latch mounting structure and is operable between latched and unlatched conditions with respect to the strike. The latch assembly includes actuating means movably mounted on the latch mounting structure and further includes a catch having a first portion defining a hook engageable with the strike and a second portion spaced a predetermined distance from the first portion with the latch in the unlatched condition and effectively retained with respect to the actuating member. Displaceable means connect the first and second catch portions with the catch means being responsive to movement of the actuating means toward a latched condition for movement of the hook into interlocking engagement with the strike and then for movement of the displaceable means and said hook to change the predetermined distance and effect a drawing of the door toward the cabinet and a latching of the door in the closed position.

Operation of the device and further objects and advantages thereof will become evident as the description proceeds and from an examination of the accompanying two pages of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
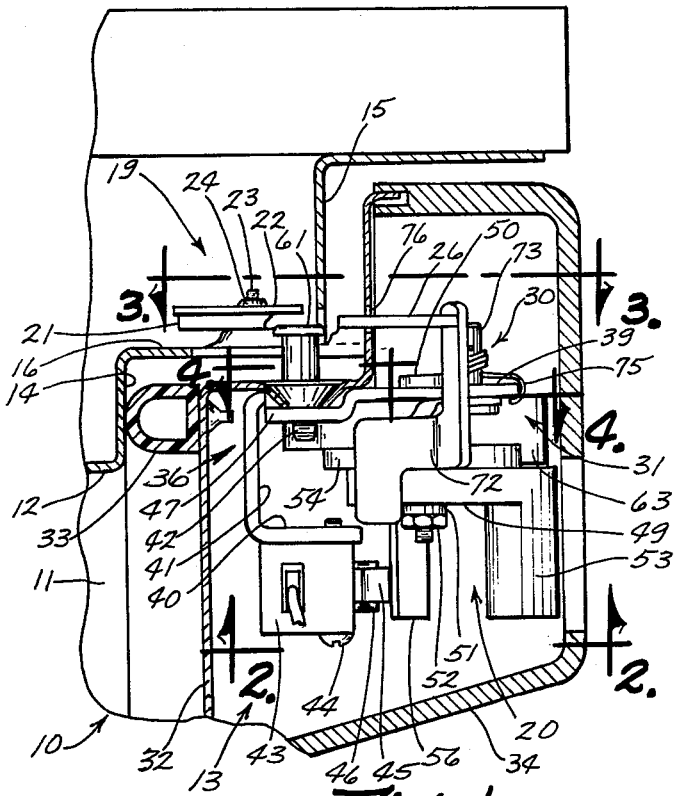
FIG. 1 is a generally vertical cross-sectional view of the door and associated parts of a dishwasher which illustrates the latch of the instant invention in the latched position.

In the drawings the numeral 10 indicates the washing chamber of a dishwasher which is generally formed by sidewalls such as 11, the top wall 12, the bottom wall or sump (not shown) and the access door 13. The top wall 12 is flanged to provide the shoulder portion 14 which in a similar manner extends along the sidewalls 11 to define the door opening. The second flange part 15 of the top wall 12 and the shoulder portion 14 are interconnected by a generally horizontal surface 16.

Figure 3:
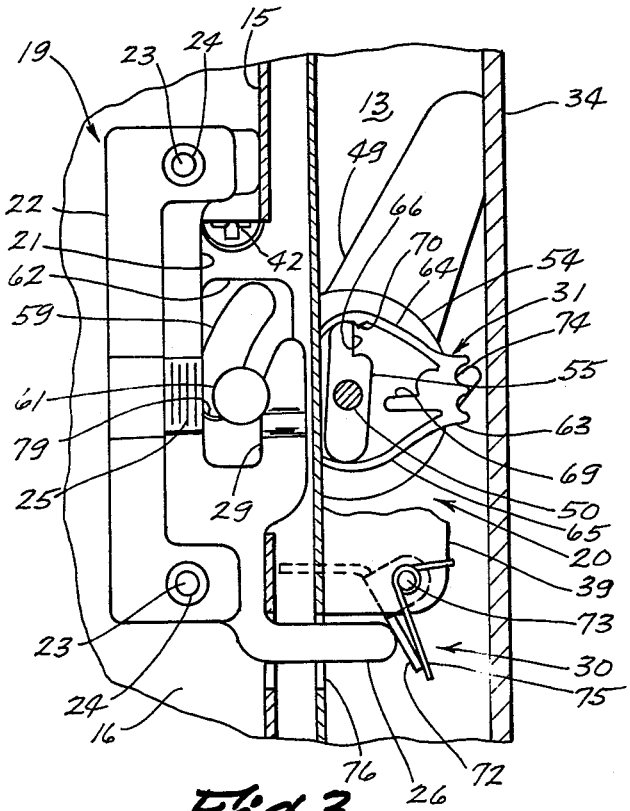
FIG. 3 is a fragmentary sectional view taken substantially along lines 3—3 of FIG. 1 showing the latch in the latched position.

As shown in FIG. 1 the strike 19 of the latch mechanism 20 is secured to the horizontal surface 16 and as best shown in FIG. 3, an adjustable strike 19 is formed from two generally flat sheet metal members 21 and 22. This strike 19 is secured to the horizontal surface 16 by a pair of threaded fasteners 23 which turn into threaded openings 24 in the second sheet metal member 22. The sheet metal members 21 and 22 are adjustable through intermeshing serrations 25 in the two members 21 and 22 and through slotted holes (not shown) in the first member 21 to allow inward and outward movement of the first member 21 with respect to the second flange part 15. The first strike member 21 includes two finger-like projections 26 and 29 with one projection 26 extending outwardly toward the access door 13 for engagement with a lockout mechanism 30. The other projection 29 extends at substantially ninety degrees to the outwardly extending projection 26 to define the strike portion which is operable for engagement with a latch catch 31.

The wall 32 of the access door 13 retains a gasket 33 formed from any suitable resilient material and which is caused to contact the shoulder portion 14 when the access door 13 is closed to effectively seal the washing chamber 10 of the dishwasher and prevent the escape of steam and/or water from the washing chamber 10.

The access door 13 additionally includes a control panel 34, housing the latch mechanism 20, which is secured by threaded fasteners (not shown) to the dishwasher access door 13. In addition to housing the latch mechanism 20 the control panel 34 houses various control devices such as cycle control switches and a timer (not shown).

Referring to FIG. 1 there is shown a channel shaped latch mounting bracket 36 having upper and lower mounting plates 39 and 40 extending to the right in generally horizontal planes and with the channel opening to the right. These upper and lower mounting plates 39 and 40 are connected by a vertical wall section 41. The latch mounting bracket 36 is secured to the top of the access door 13 within the control panel 34 by flat head machine screws 42 which fit into downwardly extruded holes in the access door 13 and thread into tapped holes in downwardly embossed dimples 47 in the upper mounting plate 39 of the latch mounting bracket 36.

Figure 2:
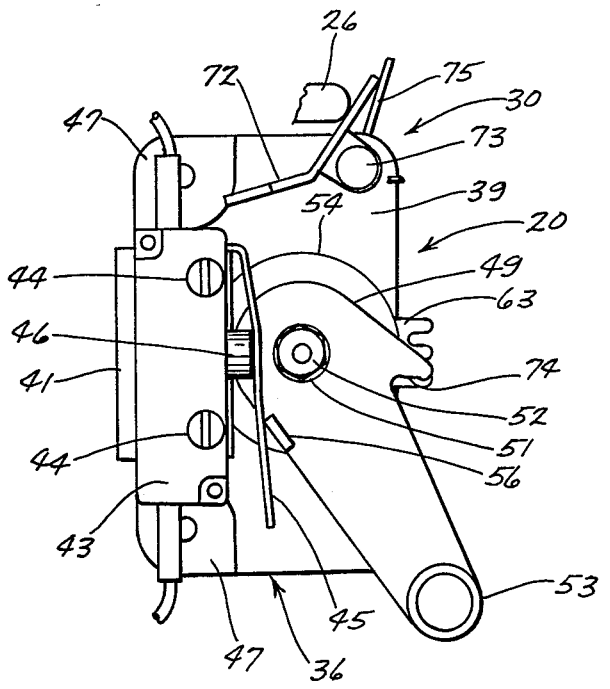
FIG. 2 is a view taken generally along lines 2—2 of FIG. 1.

The lower mounting plate 40 supports a normally open line switch 43 as shown in FIGS. 1 and 2. This line switch 43 is secured to the lower mounting plate 40 by two threaded fasteners 44. The line switch 43 includes a lever 45 for depressing the actuating button 46 to close an electrical circuit and initiate dishwasher operation when in the position shown in FIGS. 1 and 2.

FIGS. 1–4 show a rotatable handle 49 secured to the upper mounting plate 39 of the latch mounting bracket 36. FIG. 1 shows a downwardly extending pivot pin 50 which is pressed into the upper mounting plate 39. The handle 49 fits over the pivot pin 50 and is secured to the pin 50 and the upper mounting plate 39 by a washer-nut combination 51 and 52 which turns onto a threaded lower portion of the pivot pin 50. From the pivot pin 50 location the handle 49 extends outwardly toward the control panel 34. The handle 49 extends outwardly to a point convenient for operation and at this point there is located a downwardly extending operating knob 53 by which the handle 49 can be rotated in a horizontal plane about the pivot pin 50. The center section of the handle includes a circular portion 54 and an oblong cam or actuating member 55. The upper portion of the cam or actuating member 55 contacts the underside of the upper mounting plate 39. The handle 49 also includes a downwardly projecting switch actuating arm 56 which is located, as shown in FIG. 2, for operative association with the switch lever 45 to depress the switch actuating button 46 when the handle 49 is rotated.

Figure 4:
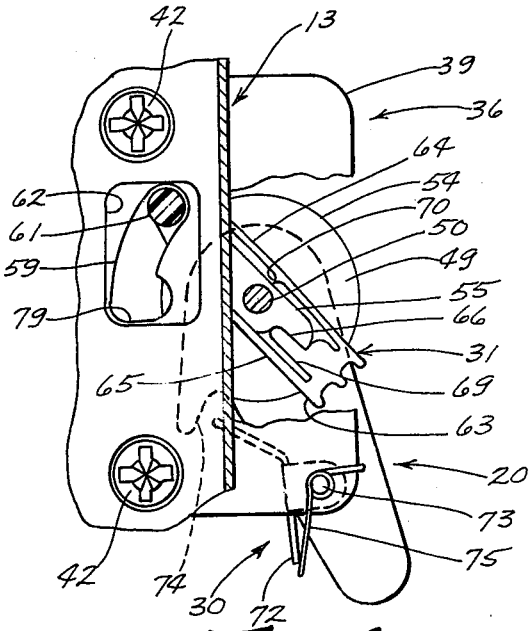
FIG. 4 is a view taken generally along lines 4—4 of FIG. 1 showing the latch in the unlatched position.

Referring generally to FIG. 4, the upper mounting plate 39 includes a 45° slot 59 located in the second quadrant of an imaginary circle having its center at the downwardly extending pivot pin 50 with an arcuate portion of the slot 59 extending from 135° to 180°. At the 180° position the slot continues radially toward the downwardly extending pivot pin 50.

Sandwiched between the circular portion 54 of the handle 49 and the upper mounting plate 39 of the latch mounting bracket 36 as shown in FIGS. 1, 3 and 4 is a latch catch 31. In a preferred embodiment this latch catch 31 is a one piece construction and molded of a resilient thermoplastic material. As shown in FIG. 4 the latch catch 31 surrounds the cam or actuating member 55 of the handle 49. At one end of the catch 31 there is an upwardly extending, cylindrically shaped, hook or peg 61 which extends through the 45° arcuate slot 59 in the upper mounting plate 39 and through a rectangular opening 62 in the flange of the access door 13. This hook or peg 61 is operable for engagement with the strike projection 29.

The other end of the latch catch 31 has a downwardly extending tab portion 63 which overhangs and engages with the edge of the circular portion 54 of the handle 49. Because this end of the latch catch 31 is engaged with the circular portion 54 of the handle 49, axial movement toward the washing chamber 10 is prevented.

As FIGS. 3 and 4 show, the two ends of the latch catch 31 are joined by relatively thin wall sections or legs 64 and 65. In the unlatched position of FIG. 4, the wall sections or legs 64 and 65 are generally parallel and juxtaposed to the cam 55. As further shown in FIGS. 3 and 4, the end of the cam 55 which is adjacent the tab end of the latch catch 31 is notched at 66 to engage with an abutment 69 at the tab end. This abutment 69 is integrally molded into the latch catch 31 and serves as a stop for the cam 55 when in the unlatched position of FIG. 4.

The wall section 64 shown at the top in FIG. 3 includes a projection 70 at approximately its midpoint. This projection 70 faces inwardly toward the cam 55 and, when the cam 55 is rotated by the handle 49, the cam 55 will ride over the projection 70 and the projection 70 will engage with the cam notch 66 in the latched position.

Also secured to the underside of the upper mounting plate 39 of the latch mounting bracket 36 as shown in FIGS. 1 – 4 is a lock-out mechanism 30 which is cooperable with the handle 49 to prevent rotation of the handle 49 when the access door 13 is open. This lock-out mechanism 30 includes a lever 72 pivotally mounted on an upwardly extending pin 73 which is pressed into the upper mounting plate 39 from below and which extends through the plate 39 as shown in FIG. 1. This lever 72 is biased into engagement with a detent 74 in the handle 49 by a torsion spring 75 which wraps around the pin 73 and has one end hooked over the edge of the upper mounting plate 39 and the other end against the lever 72. The actual engagement of the lever 72 with the detent 74 is best shown in the dashed lines of FIG. 4. This lock-out mechanism 30 is aligned with the outwardly extending projection 26 of the strike 19 which will pivot the lever 72 about the pin 73 and away from the detent 74 in the handle 49 to allow the handle 49 to be rotated toward a latching position.

FIGS. 1, 2 and 3 show the latch mechanism 20 in the latched position while FIG. 4 shows it in the unlatched position. Closing the access door 13 enables the outwardly extending projection 26 of the strike 19 to extend through an opening 76 in the access door 13 to contact the lever 72 of the lock-out mechanism 30 and pivot the lever 72 away from the handle detent 74. This movement of the lever 72 frees the handle 49 for rotation in a horizontal plane about the vertical axis of the pivot pin 50. During the first 45° of handle 49 rotation the latch catch 31 rotates with the handle 49 as the cylindrical hook or peg portion 61 of the latch catch 31 travels in the 45° arcuate slot 59 from the position in FIG. 4 to a position behind the strike projection 29. At this point the hook or peg 61 is constrained from further arcuate movement by contact with the sidewall 79 of the slot 59. Another 90° of handle 49 rotation moves the upstanding actuating member 55 to the latched position as shown in FIG. 3. During this last 90° of rotation the latch catch 31 wall sections or legs 64 and 65 are deformed to decrease the length and increase the width of the latch catch 31 whereby the hook 61 end is shortened by approximately 5/32 of an inch to draw the access door 13 into a tight sealing engagement with the washing chamber 10. As the handle 49 reaches the end of the last 90° of travel the notched portion 66 of the cam 55 engages with the projection 70 on the wall section 64 which serves as a lock.

As the handle 49 is rotated in the opposite direction to return the latch catch 31 to the unlatched position, the resilient latch catch 31 will return to generally the shape as shown in FIG. 4 without the aid of a biasing member due to the resiliency of the molded plastic latch catch 31.

Figure 5:
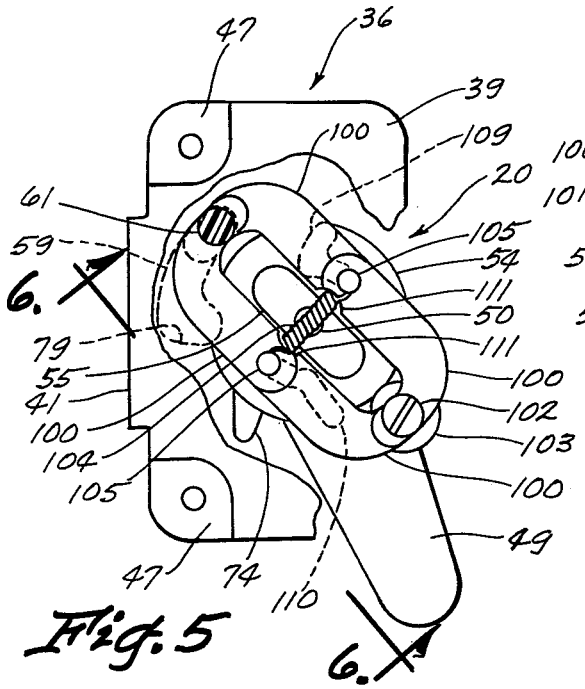
FIG. 5 is a partial fragmentary section view similar to FIG. 4 showing an alternate embodiment of the invention in the unlatched position.
Figure 6:
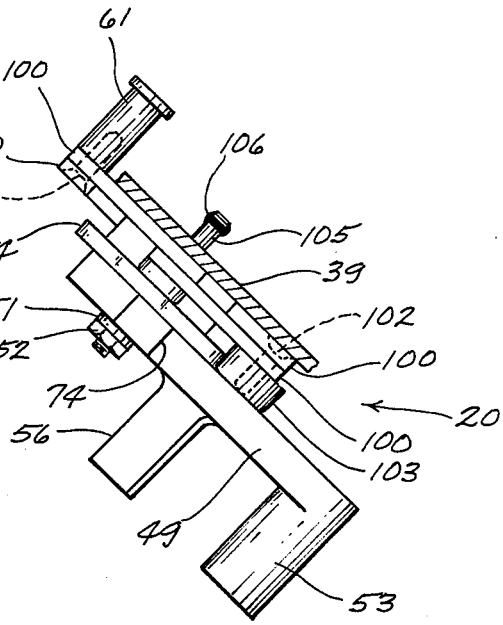
FIG. 6 is a view taken generally along lines 6—6 of FIG. 5.

FIGS. 5 and 6 depict an alternate embodiment of the latch catch 31. These figures show a mechanism which utilizes four like bars 100 pinned at the pivoted joints. At the hook or peg 61 end of the latch catch 31 a threaded fastener 101 shown in dashed lines serves as a pivot and secures the hook or peg 61 to the bar linkage 100. At the opposite end a second threaded fastener 102 shown in dashed lines serves as a pivot and is tapped directly into a circular button 103 which overhangs and engages with the edge of the circular portion 54 of the handle 49 as does the downwardly extending tab portion 63 of the latch catch 31 in the first embodiment to prevent axial movement of this tab end.

An extension spring 104 across two upwardly extending pivot pins 105 biases the bar linkage toward the position as shown in FIG. 6. As further shown in FIGS. 5 and 6, these two upwardly extending pins 105 form the central pivots for the linkage and also provide the attachment points 106 for the extension spring 104. In FIG. 5 the 45° arcuate slot 59 which defines the path followed by the hook or peg 61 is shown in dashed lines. Also shown in dashed lines are two additional arcuate slots 109 and 110 in the upper mounting plate 39 which define the paths followed by the upwardly extending pivot pins 105 as the latch mechanism 20 is latched and unlatched. These two additional arcuate slots 109 and 110 allow the pivot pins 105 to move outwardly as the handle 49 is rotated. The bars 100 are radiused to form notches 111 adjacent the upwardly extending pivot pin 105 locations as shown in FIG. 5 to provide stops for the cam or actuating member 55 of the handle 49 which, in this embodiment, is simply a rectangular shape rounded at both ends.

This second embodiment operates esentially the same as the first embodiment. During the first 45° of handle 49 rotation the latch catch 31 moves with the handle 49 to position the hook or peg 61 behind the strike projection 29. During the next 90° of rotation the cam 55 moves the pins 105 in the arcuate slots 109 and 110 to spread the mechanism and shorten the peg or hook 61 end of the latch catch 31. The cam 55 rests in the radiused notches 111 in the bars 100 at the end of the last 90° of rotation. Upon return of the handle 49 to the unlatched position the extension spring 104 will return the latch catch 31 to its original shape as shown in FIG. 5.

It is therefore seen that the instant invention provides a novel appliance latch mechanism utilizing a catch member which can concurrently increase in width and shorten in length.

While specific embodiments of the instant invention have been shown, it is to be understood that the invention also encompasses alternate embodiments not shown herein. For instance, the latch catch 31 could be arranged so that the length increases as the width decreases or so that the length decreases as the width simultaneously decreases to move the peg or hook 61.

In the drawings and specifications there has been set forth a preferred embodiment of the invention and although specific terms are implied these are used in a generic and descriptive sense only and not for purposes of limitation. Changes in the form and the proportion of parts, as well as the substitution of equivalents are contemplated, as circumstances may suggest or render expedient, without departing from the spirit or scope of this invention as defined in the following claims.

I claim:

1. A latch mechanism for an appliance having a cabinet and an access door movable between an open and a closed position, the combination comprising: strike means on one of said cabinet and said access door; latch mounting means on the other of said cabinet and said access door; and a latch assembly on said latch mounting means and operable between latched and unlatched conditions with respect to said strike means, said latch assembly including actuating means movably mounted on said latch mounting means and further including catch means having a first portion defining a hook engageable with said strike means, a second portion spaced a predetermined distance from said first portion with said latch assembly in said unlatched condition and effectively retained with respect to said actuating means in the general direction of access door movement, and displaceable means connecting said first and second portions, said catch means being responsive to movement of said actuating means toward said latched condition for movement of said hook into interlocking engagement with said strike means and then for movement of said displaceable means and said hook to change said predetermined distance and effect a drawing of said access door toward said cabinet and a latching of said access door in said closed position.

2. A latch mechanism as defined in claim 1 wherein said latch assembly includes a handle for moving said actuating means between said unlatched and latched conditions.

3. A latch mechanism as defined in claim 1 wherein said displaceable means is responsive to movement of said actuating means to concurrently decrease the length and increase the width of said catch means when moved from said unlatched to said latched condition.

4. A latch mechanism as defined in claim 1 wherein said catch means is unitary and resilient with said displaceable means being deformable by said actuating means.

5. A latch mechanism for an appliance having a cabinet and an access door movable between an open and a closed position, the combination comprising: strike means on one of said cabinet and said access door; latch mounting means on the other of said cabinet and said access door; and a latch assembly including a handle on said latch mounting means and operable between latched and unlatched conditions with respect to said strike means, said latch assembly further including actuating means mounted for movement with said handle and catch means associated with said actuating means, said catch means having a first portion defining a hook engageable with said strike means, a tap portion spaced a predetermined distance from said first portion with said latch assembly in said unlatched condition and effectively retained with respect to said actuating means in the general direction of access door movement, and a pair of displaceable legs connecting said first portion and said tab portion, said catch means being responsive to movement of said handle and said actuating means toward said latched condition for movement of said hook into interlocking engagement with said strike means and for moving said displaceable legs and said hook to change said predetermined distance by decreasing the length while concurrently increasing the width of said catch means to effect a drawing of said access door toward said cabinet and a latching of said access door in said closed position.

6. A latch mechanism as defined in claim 5 wherein said actuating means includes a cam portion operable for moving said displaceable legs when said handle is moved toward said latched condition.

7. A latch mechanism as defined in claim 5 wherein said catch means further includes an abutment adjacent said tab portion and a projection on one of said displaceable legs where said abutment serves as a stop and said projection serves as a lock for said actuating means in said unlatched and latched conditions respectively.

8. A latch mechanism for an appliance having a cabinet and an access door movable between an open and a closed position with a resilient sealing gasket between the cabinet and access door in the closed position thereof, the combination comprising: strike means on one of said cabinet and said access door; latch mounting means on the other of said cabinet and said access door; and latch means including a handle on said latch mounting means and operable between latched and unlatched conditions with respect to said strike means, said latch means further including actuating means mounted for movement with said handle and a resilient unitary catch member associated with said actuating means, said catch member having a hook portion engageable with said strike means, a tab portion spaced a predetermined distance from said hook portion with said latch means in said unlatched condition and effectively retained by said handle with respect to said actuating means in the general direction of access door movement, and a pair of displaceable elements connecting said hook portion and said tab portion, said displaceable elements of said catch member being deformable responsive to movement of said actuating member to move said hook portion from said unlatched condition to a strike engaging posture and finally to said latched condition for compressing said sealing gasket in a sealing arrangement between said access door and said cabinet.

9. A latch mechanism as defined in claim 8 wherein said actuating means includes a cam portion operable for deforming said displaceable elements as said handle is moved toward said latched condition.

10. A latch mechanism as defined in claim 8 wherein said latch mounting means includes means for mounting an appliance actuating switch with said switch being operable to an appliance-energizing condition by said handle when in said latched condition.

11. A latch mechanism as defined in claim 8 wherein said latch mounting means further includes lockout means engageable with said handle in said unlatched condition when said access door is open to prevent rotation of said handle, said lockout means is contacted by a portion of said strike means when said access door is closed to move said lockout means out of engagement with said handle and allow rotation of said handle toward said latched condition.

* * * * *